US005557305A

United States Patent [19]

Hine et al.

[11] Patent Number: 5,557,305

[45] Date of Patent: Sep. 17, 1996

[54] INK JET PURGING ARRANGEMENT

[75] Inventors: Nathan P. Hine, South Strafford, Vt.; David W. Gailus, Merrimack, N.H.

[73] Assignee: Spectra, Inc., Hanover, N.H.

[21] Appl. No.: 201,001

[22] Filed: Feb. 24, 1994

[51] Int. Cl.[6] ..... B41J 2/165

[52] U.S. Cl. ..... 347/17; 347/25; 347/88

[58] Field of Search ..... 347/22, 25, 26, 347/29, 30, 33, 88, 92, 17

[56] References Cited

U.S. PATENT DOCUMENTS

| | | | |
|---|---|---|---|
| 4,558,326 | 12/1985 | Kimura et al. | 347/30 |
| 4,806,955 | 2/1989 | Koto et al. | 347/30 |
| 4,937,598 | 6/1990 | Hine et al. | 347/92 |
| 5,030,972 | 7/1991 | Miyazawa et al. | 347/88 |
| 5,053,787 | 10/1991 | Terasawa et al. | 347/92 |
| 5,343,228 | 8/1994 | Takada | 347/30 |

FOREIGN PATENT DOCUMENTS

| | | | |
|---|---|---|---|
| 59-225959 | 12/1984 | Japan | 347/92 |
| 2-112947 | 10/1990 | Japan | 347/92 |
| 3-182362 | 8/1991 | Japan | 347/92 |

*Primary Examiner*—John E. Barlow, Jr.
*Attorney, Agent, or Firm*—Brumbaugh, Graves, Donohue & Raymond

[57] ABSTRACT

An ink jet head has a reservoir containing hot melt ink and an orifice plate with orifices, along with passages leading from the reservoir to the orifices to conduct ink thereto. The ink jet head includes a heater to melt the ink in the reservoir, along with a further heater to heat air in the airspace above the ink in the reservoir, and the reservoir has a sealable vent which is sealed by a sealing element at a maintenance station so that heating of the air increases the pressure in the reservoir to cause purging, an absorbent member being provided at the maintenance station adjacent to the orifice plate to trap ink ejected during purging.

12 Claims, 1 Drawing Sheet

INK JET PURGING ARRANGEMENT

BACKGROUND OF THE INVENTION

This invention relates to purging arrangements for ink jet systems and, more particularly, to a new and improved ink jet purging system. In the Hine et al. U.S. Pat. No. 4,937,598, an ink jet purging system is disclosed in which a syringe having a plunger actuated by reciprocating motion of the ink jet head generates air pressure which is applied through a vent to the region above an ink supply in an ink reservoir on the ink jet head. That arrangement requires not only a syringe and a mechanical linkage arrangement for selectively connecting the syringe plunger to the ink jet head, but also requires a flexible conduit arrangement to connect the syringe, which is stationary, to the reservoir on the moving ink jet head.

SUMMARY OF THE INVENTION

Accordingly, it is an object of the present invention to provide an ink jet head with a purging arrangement which overcomes the disadvantages of the prior art.

Another object of the present invention is to provide an ink jet head with a simple and convenient purging arrangement.

These and other objects of the invention are attained by providing an ink jet head having a reservoir containing ink and including an airspace above the ink and also having a heating arrangement for heating the air in the reservoir to produce an increase in pressure on the ink in the reservoir so as to cause purging of ink in an orifice passageway to which the reservoir is connected. In one embodiment, the reservoir has a vent and the purging arrangement includes a seal for the vent so that, when the reservoir is heated either by an internal heater or from an external heat source, the pressure in the air within the reservoir is increased.

If desired, the reservoir may contain a heater in the airspace above the level of the ink to facilitate heating of the air. Alternatively, the temperature of both the ink and the air in the reservoir may be heated by internal or external application of heat to increase the air pressure. Preferably, the ink jet head is moved to a maintenance station at which a sealing element in a maintenance unit seals the reservoir vent and power is supplied to an internal heater disposed in the airspace in the reservoir. In addition, the maintenance unit may include a pad or a paper web to engage the orifice plate so as to receive ink ejected during purging and to clean the orifice plate after purging.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
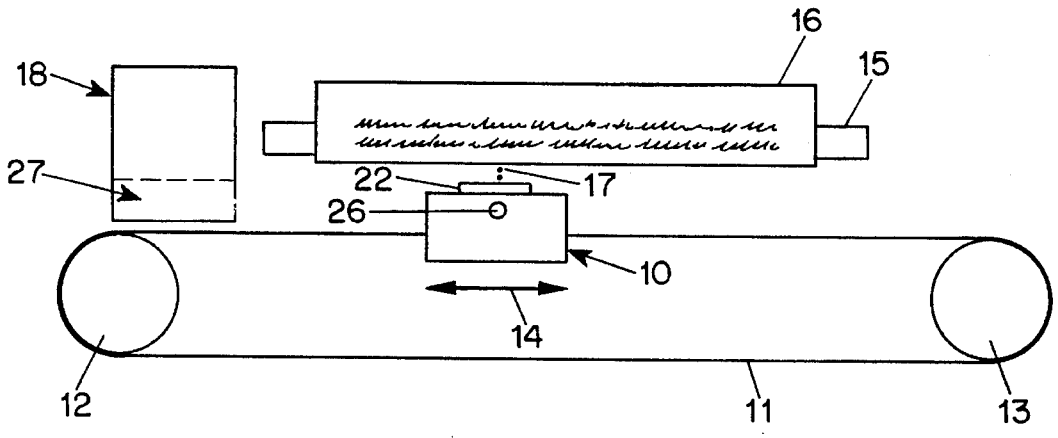
FIG. 1 is a schematic plan view illustrating the mounting and operation of a representative ink jet head in accordance with the invention.

In the typical embodiment of the invention illustrated in the drawings, an ink jet head 10 is supported on an endless belt 11 extending around two support drums 12 and 13 for reciprocating motion in the direction of the arrow 14 adjacent to a platen 15 upon which a substrate 16 is supported. During the reciprocating motion, the ink jet head 10 is arranged in the usual manner to eject ink drops 17 toward the substrate 16, which is moved in the direction perpendicular to the motion of the head, so as to produce a predetermined pattern on the surface of the substrate. Preferably, the head 10 is of the refillable or disposable type described, for example, in the copending Hoisington et al. application Ser. No. 08/143,166 filed Oct. 26, 1993. In the typical embodiment shown in the drawings, a maintenance unit 18 is positioned at one end of the path of motion of the reciprocating head 10, and the head is positioned adjacent to the maintenance unit whenever the system has been turned on and periodically during operation if purging or other maintenance is necessary.

Figure 2:
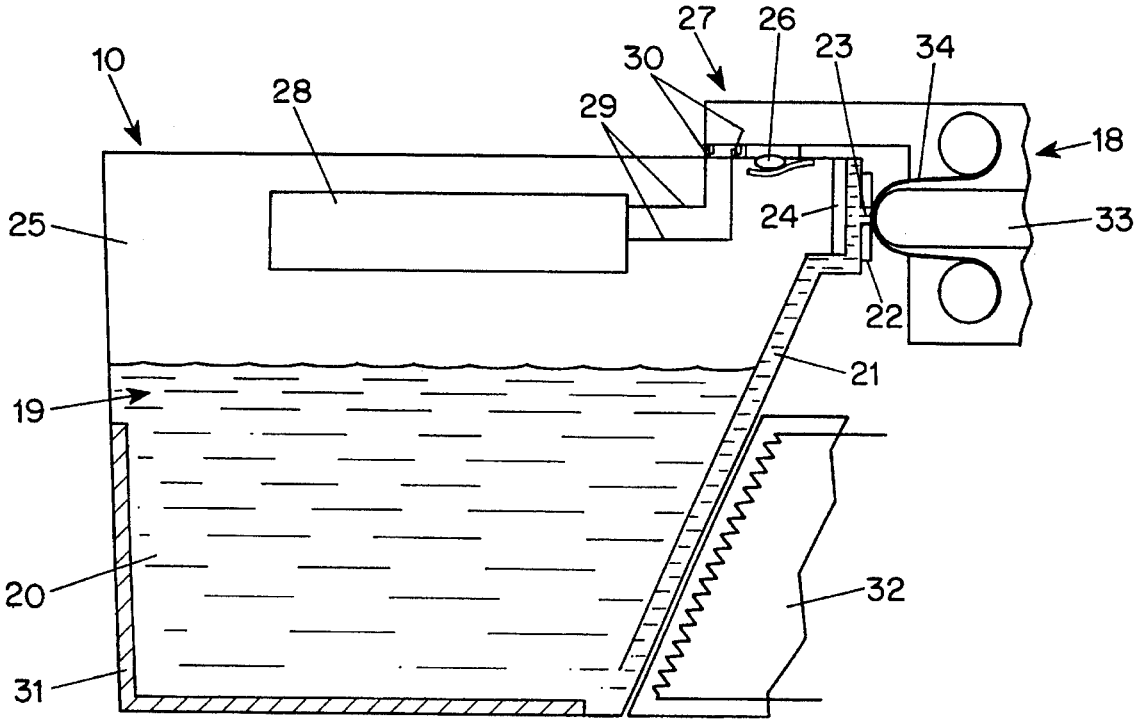
FIG. 2 is an enlarged schematic sectional view illustrating the arrangement of the representative ink jet head shown in FIG. 1 and an associated maintenance station arranged in accordance with the invention.

As best seen in the cross-sectional view of FIG. 2, the head 10 includes a reservoir 19 containing a supply of ink 20 and an ink passage 21 for conducting ink from the reservoir to an orifice plate 22 having an array of orifices 23 through which ink is ejected in response to actuation of corresponding transducers 24.

In order to flush trapped air or debris from the passages leading to the orifices 23 in accordance with the invention, the air in the reservoir airspace 25 above the ink 20 in the reservoir 19 is heated sufficiently to increase the pressure in the reservoir by about 1 psi. To maintain the increased pressure, an air vent 26 in the wall of the reservoir 19 is closed while the air in the airspace 25 is being heated. This may be accomplished by providing a one-way valve at the air vent 26 or by providing a sealing cap 27 in the maintenance unit 18 which, as shown in FIG. 2, fits closely over and seals the vent 26 when the head 10 is positioned at the maintenance station.

Heating of the air in the airspace 19 may be accomplished by a heater 28 mounted in a wall of the reservoir bordering the airspace 25, to which electrical power is supplied through wires 29 leading to contacts 30 which are engaged by corresponding contacts in the maintenance unit 18 to supply power thereto.

If the ink 20 in the reservoir is hot melt ink, which is normally solid at room temperature and is applied at an elevated temperature in which the ink is in molten form, a heater 31 may be mounted on a wall of the reservoir adjacent to the ink supply 20 and controlled so as to maintain the ink in the reservoir in molten condition during operation. Alternatively or in addition, an external heat source 32 adjacent to the ink jet head 10 may be used to melt the ink 20 in the reservoir and to control the temperature of the ink as well as the air within the reservoir rather than relying upon the heaters 28 and 31.

As the temperature of the air in the space 19 is elevated with the reservoir vent 26 sealed to prevent escape of air, the ink 20 is forced through the passage 21 toward the orifices 23 and the orifice plate 22, causing ink in the orifice passageways to be forced out through the orifices. To trap ink thus ejected from the orifices, the maintenance unit 18 includes a pressure bar 33 which holds an absorbent web 34 against the orifice plate 22 to absorb the ink forced through the orifices during purging.

In a typical operation at start-up using hot melt ink 20, which is solid at room temperature, the heater 31 initially heats the ink 20 to about 80° C., at which it is molten, and the head 10 is then moved to the maintenance station where the vent 26 is sealed by the sealing portion 27 in the maintenance unit 18. The heater 31 and/or the heater 32 then raises the temperature of the ink to an operating temperature of about 100° C., at the same time heating the air in the space 19 above the ink to the same temperature to produce an increase in pressure of about 1 psi. This pressure is maintained for about 30 sec., which is sufficient to force molten ink 20 from the reservoir through the passage 21 and through the orifices in the orifice plate to expel any air bubbles or debris from the ink passages, the ink being trapped by the absorbent web 34. Thereafter, assuming the operating temperature of the head is 100° C., the head is moved away from the maintenance unit 18 and is ready for operation.

If purging is required during operation of the system, the head is returned to the maintenance station so that the vent 26 is sealed by the sealing portion 27 and the ink, as well as the air in the space 19, are heated to about 120° C., which is sufficient to produce a 1 psi pressure, causing purging as described above, after which the head is cooled to its operating temperature of, for example, 100° C. and printing is continued.

If desired, the air in the space 19 may be heated directly by the heater 28 rather than heating the ink as well as the air with the heater 31 or 32 in order to effect purging by increased pressure in the reservoir. Moreover, if the ink 20 is liquid at room temperature rather than being hot melt ink, the heaters 31 and 32 are not required and the necessary increase in temperature in the space 19 above the ink may be effected in all cases by the heater 28.

If the vent 26 is provided with a one-way valve which permits air intake into the reservoir as ink is used during operation, but seals the reservoir as the air pressure is increased rather than requiring sealing by the sealing portion 27 of the maintenance station, the maintenance unit may be arranged to force the check valve open when sufficient purging time, for example, about 30 sec., has elapsed.

Although the invention has been described herein with reference to specific embodiments, many modifications and variations therein will readily occur to those skilled in the art. Accordingly, all such variations and modifications are included within the intended scope of the invention.

I claim:

1. An ink jet head comprising a reservoir containing ink and having an airspace, an orifice plate containing an orifice through which ink is ejected during operation of the system, a passage for conducting ink from the reservoir to prevent communication between the airspace and the exterior of the reservoir to the orifice, sealable vent means for sealing the airspace in the reservoir, and heater means within the reservoir and the ink jet head for heating air in the reservoir airspace to force ink from the reservoir through the ink passage and out of the orifice for purging thereof.

2. An ink jet head according to claim 1 wherein the heater means includes a heater for heating the ink in the reservoir as well as the air in the reservoir airspace.

3. An ink jet head according to claim 1 wherein the heater means includes a heater in the reservoir airspace.

4. An ink jet head according to claim 1 wherein the sealable vent means includes a check valve.

5. An ink jet head according to claim 1 including a maintenance station having a sealing element for sealing the sealable vent means in the reservoir.

6. An ink jet system comprising an ink jet head including a reservoir with an airspace and an orifice plate containing an orifice and a passage for conducting ink from the reservoir to the orifice, heater means within the reservoir in the ink jet head for heating the air in the airspace, and a maintenance unit having a sealing element for sealing a vent in the reservoir to prevent communication between the airspace and the exterior of the reservoir and for trapping ink expelled through the orifice by an increase in the air pressure in the reservoir airspace.

7. An ink jet system according to claim 6 wherein the heater means comprises a first heater disposed in a lower portion of the reservoir to heat ink contained in the reservoir and a second heater disposed in the airspace of the reservoir to heat the air in the reservoir airspace.

8. A method for purging an ink jet head containing an ink reservoir holding ink and having an airspace with a sealable vent and including an ink passage leading from the ink reservoir to an orifice in an orifice plate comprising the step of sealing the sealable vent to prevent communication between the reservoir airspace and the exterior of the reservoir and heating the air in the reservoir airspace in the ink jet head to increase the air pressure in the reservoir airspace and force ink from the reservoir in the ink jet head through the ink passage and through the orifice to purge bubbles or debris therefrom.

9. A method according to claim 8 including sealing the sealable vent with a sealing element at a maintenance station.

10. A method according to claim 8 wherein the ink in the reservoir is hot melt ink and including the step of heating the ink in the reservoir to melt the ink prior to sealing the reservoir vent and thereafter increasing the temperature of the ink in the reservoir while increasing the temperature of the air in the reservoir airspace and thereby increasing the pressure thereof.

11. A method according to claim 8 wherein the ink in the reservoir is hot melt ink and including the steps of maintaining the ink at an operating temperature during operation of the ink jet head, moving the ink jet head to a maintenance station, sealing the sealable vent, and increasing the temperature of the ink in the ink jet head to a temperature above the operating temperature in order to purge ink in the passageway leading to the ink jet orifice and thereafter reducing the temperature of the ink to the operating temperature of the system.

12. A method according to claim 8 including trapping ink expelled from the orifice with an absorbent member.

* * * * *